US009648410B1

(12) United States Patent
Kratsas et al.

(10) Patent No.: US 9,648,410 B1
(45) Date of Patent: May 9, 2017

(54) CONTROL OF AUDIO OUTPUT OF HEADPHONE EARBUDS BASED ON THE ENVIRONMENT AROUND THE HEADPHONE EARBUDS

(71) Applicant: Cirrus Logic, Inc., Austin, TX (US)

(72) Inventors: Robert George Kratsas, Austin, TX (US); Roy Scott Kaller, Austin, TX (US)

(73) Assignee: CIRRUS LOGIC, INC., Austin, TX (US)

( * ) Notice: Subject to any disclaimer, the term of this patent is extended or adjusted under 35 U.S.C. 154(b) by 109 days.

(21) Appl. No.: 14/207,053

(22) Filed: Mar. 12, 2014

(51) Int. Cl.
*G10K 11/16* (2006.01)
*H04R 1/10* (2006.01)
*H04R 3/00* (2006.01)

(52) U.S. Cl.
CPC ..... *H04R 1/1041* (2013.01); *H04R 3/00* (2013.01); *G10K 2210/1081* (2013.01)

(58) Field of Classification Search
CPC ..... G10K 2210/1081
USPC ..... 381/71.1, 71.6, 74, 58
See application file for complete search history.

(56) References Cited

U.S. PATENT DOCUMENTS 5,044,373 A 9/1991 Northeved et al.
5,251,263 A 10/1993 Andrea et al.
5,278,913 A 1/1994 Delfosse et al.
5,321,759 A 6/1994 Yuan
5,337,365 A 8/1994 Hamabe et al.
5,359,662 A 10/1994 Yuan et al.
5,410,605 A 4/1995 Sawada et al.
5,425,105 A 6/1995 Lo et al.
5,445,517 A 8/1995 Kondou et al.
5,465,413 A 11/1995 Enge et al.
5,548,681 A 8/1996 Gleaves et al.
5,586,190 A 12/1996 Trantow et al.
5,640,450 A 6/1997 Watanabe
5,699,437 A 12/1997 Finn
5,706,344 A 1/1998 Finn
5,740,256 A 4/1998 Castello Da Costa et al.
5,768,124 A 6/1998 Stothers et al.
(Continued)

FOREIGN PATENT DOCUMENTS

DE 102011013343 A1 9/2012
EP 1880699 A2 1/2008
(Continued)

OTHER PUBLICATIONS

U.S. Appl. No. 14/101,777, Alderson et al.
(Continued)

*Primary Examiner* — Disler Paul
(74) *Attorney, Agent, or Firm* — Norton Rose Fulbright US LLP

(57) ABSTRACT

A headphone earbud may include a sensor to determine characteristics of an environment around the headphone earbud. The sensor may be integrated with the headphone earbud to measure a distance from the headphone earbud to a user's ear drum. This distance may be used to control an audio output of the headphone earbud, such as through an adaptive noise cancellation (ANC) algorithm. Control over the audio output may be performed by an audio integrated circuit (IC) integrated within the headphone earbud or within a mobile device coupled to the headphone earbud.

20 Claims, 5 Drawing Sheets

(56) References Cited

U.S. PATENT DOCUMENTS 5,815,582 A 9/1998 Claybaugh et al.
5,832,095 A 11/1998 Daniels
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,304,179 B1 * 10/2001 Lotito ..... G01S 7/521 280/728.1
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran et al.
6,768,795 B2 7/2004 Feltstrom et al.
6,850,617 B1 2/2005 Weigand
6,940,982 B1 9/2005 Watkins
7,016,504 B1 * 3/2006 Shennib ..... A61B 5/121 381/60
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,680,456 B2 3/2010 Muhammad et al.
7,742,790 B2 6/2010 Konchitsky et al.
7,817,808 B2 10/2010 Konchitsky et al.
8,019,050 B2 9/2011 Mactavish et al.
D666,169 S 8/2012 Tucker et al.
8,249,262 B2 8/2012 Chua et al.
8,251,903 B2 8/2012 LeBoeuf et al.
8,290,537 B2 10/2012 Lee et al.
8,325,934 B2 12/2012 Kuo
8,379,884 B2 2/2013 Horibe et al.
8,401,200 B2 3/2013 Tiscareno et al.
8,442,251 B2 5/2013 Jensen et al.
8,526,627 B2 9/2013 Asao et al.
8,848,936 B2 9/2014 Kwatra et al.
8,907,829 B1 12/2014 Naderi
8,908,877 B2 12/2014 Abdollahzadeh Milani et al.
8,948,407 B2 2/2015 Alderson et al.
8,958,571 B2 2/2015 Kwatra et al.
2001/0053228 A1 12/2001 Jones
2002/0003887 A1 1/2002 Zhang et al.
2003/0063759 A1 4/2003 Brennan et al.
2003/0185403 A1 10/2003 Sibbald
2004/0047464 A1 3/2004 Yu et al.
2004/0165736 A1 8/2004 Hetherington et al.
2004/0167777 A1 8/2004 Hetherington et al.
2004/0202333 A1 10/2004 Csermak et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0035593 A1 2/2006 Leeds
2006/0069556 A1 3/2006 Nadjar et al.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0177532 A1 7/2008 Greiss et al.
2008/0181422 A1 7/2008 Christoph
2008/0226098 A1 9/2008 Haulick et al.
2008/0240455 A1 10/2008 Inoue et al.
2008/0240457 A1 10/2008 Inoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124336 A1 5/2010 Shridhar et al.
2010/0124337 A1 5/2010 Wertz et al.
2010/0131269 A1 5/2010 Park et al.
2010/0150367 A1 6/2010 Mizuno
2010/0158330 A1 6/2010 Guissin et al.
2010/0166203 A1 7/2010 Peissig et al.
2010/0195838 A1 8/2010 Bright
2010/0195844 A1 8/2010 Christoph et al.
2010/0207317 A1 8/2010 Iwami et al.
2010/0239126 A1 9/2010 Grafenberg et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0322430 A1 12/2010 Isberg
2011/0007907 A1 1/2011 Park et al.
2011/0106533 A1 5/2011 Yu
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0158419 A1 6/2011 Theverapperuma et al.
2011/0206214 A1 8/2011 Christoph et al.
2011/0222698 A1 9/2011 Asao et al.
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0099736 A1 * 4/2012 Rashid ..... G10K 11/178 381/71.6
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0207317 A1 8/2012 Abdollahzadeh Milani et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.

(56) References Cited

U.S. PATENT DOCUMENTS

| | | | | |
|---|---|---|---|---|
| 2012/0281850 | A1 | 11/2012 | Hyatt | |
| 2012/0300958 | A1 | 11/2012 | Klemmensen | |
| 2012/0300960 | A1 | 11/2012 | Mackay et al. | |
| 2012/0308021 | A1 | 12/2012 | Kwatra et al. | |
| 2012/0308024 | A1 | 12/2012 | Alderson et al. | |
| 2012/0308025 | A1 | 12/2012 | Hendrix et al. | |
| 2012/0308026 | A1 | 12/2012 | Kamath et al. | |
| 2012/0308027 | A1 | 12/2012 | Kwatra | |
| 2012/0308028 | A1 | 12/2012 | Kwatra et al. | |
| 2012/0310640 | A1 | 12/2012 | Kwatra et al. | |
| 2013/0010982 | A1 | 1/2013 | Elko et al. | |
| 2013/0034234 | A1* | 2/2013 | Chen | H04M 1/72591 381/58 |
| 2013/0083939 | A1 | 4/2013 | Fellers et al. | |
| 2013/0243198 | A1 | 9/2013 | Van Rumpt | |
| 2013/0243225 | A1 | 9/2013 | Yokota | |
| 2013/0272539 | A1 | 10/2013 | Kim et al. | |
| 2013/0287218 | A1 | 10/2013 | Alderson et al. | |
| 2013/0287219 | A1 | 10/2013 | Hendrix et al. | |
| 2013/0301842 | A1 | 11/2013 | Hendrix et al. | |
| 2013/0301846 | A1 | 11/2013 | Alderson et al. | |
| 2013/0301847 | A1 | 11/2013 | Alderson et al. | |
| 2013/0301848 | A1 | 11/2013 | Zhou et al. | |
| 2013/0301849 | A1 | 11/2013 | Alderson et al. | |
| 2013/0343556 | A1 | 12/2013 | Bright | |
| 2013/0343571 | A1 | 12/2013 | Rayala et al. | |
| 2014/0016803 | A1* | 1/2014 | Puskarich | H04R 1/1041 381/309 |
| 2014/0044275 | A1 | 2/2014 | Goldstein et al. | |
| 2014/0050332 | A1 | 2/2014 | Nielsen et al. | |
| 2014/0086425 | A1 | 3/2014 | Jensen et al. | |
| 2014/0146976 | A1* | 5/2014 | Rundle | H04R 1/1083 381/71.6 |
| 2014/0177851 | A1 | 6/2014 | Kitazawa et al. | |
| 2014/0211953 | A1 | 7/2014 | Alderson et al. | |
| 2014/0270222 | A1 | 9/2014 | Hendrix et al. | |
| 2014/0270223 | A1 | 9/2014 | Li et al. | |
| 2014/0270224 | A1 | 9/2014 | Zhou et al. | |
| 2015/0092953 | A1 | 4/2015 | Abdollahzadeh Milani et al. | |
| 2015/0104032 | A1 | 4/2015 | Kwatra et al. | |

FOREIGN PATENT DOCUMENTS

| | | | |
|---|---|---|---|
| EP | 1947642 | A1 | 7/2008 |
| EP | 2133866 | A1 | 12/2009 |
| EP | 2216774 | A1 | 8/2010 |
| EP | 2395500 | A1 | 12/2011 |
| EP | 2395501 | A1 | 12/2011 |
| GB | 2401744 | A | 11/2004 |
| GB | 2455821 | A | 6/2009 |
| GB | 2455824 | A | 6/2009 |
| GB | 2455828 | A | 6/2009 |
| GB | 2484722 | A | 4/2012 |
| JP | H06186985 | A | 7/1994 |
| WO | 03015074 | A1 | 2/2003 |
| WO | 03015275 | A1 | 2/2003 |
| WO | 2004009007 | A1 | 1/2004 |
| WO | 2004017303 | A1 | 2/2004 |
| WO | 2007/007916 | A1 | 1/2007 |
| WO | 2007/113487 | A1 | 10/2007 |
| WO | 2010/117714 | A1 | 10/2010 |
| WO | 2012/134874 | A1 | 10/2012 |

OTHER PUBLICATIONS

U.S. Appl. No. 14/101,955, Alderson.
U.S. Appl. No. 13/896,526, Naderi.
U.S. Appl. No. 13/924,935, Hellman.
U.S. Appl. No. 13/968,013, Abdollahzadeh Milani et al.
U.S. Appl. No. 14/252,235, Lu et al.
U.S. Appl. No. 13/724,656, Lu et al.
U.S. Appl. No. 13/721,832, Lu et al.
U.S. Appl. No. 13/762,504, Abdollahzadeh Milani et al.
U.S. Appl. No. 14/210,537, Abdollahzadeh Milani et al.
U.S. Appl. No. 14/210,589, Abdollahzadeh Milani et al.
U.S. Appl. No. 14/228,322, Alderson et al.
U.S. Appl. No. 14/197,814, Kaller et al.
U.S. Appl. No. 14/029,159, Li et al.
U.S. Appl. No. 14/062,951, Zhou et al.
U.S. Appl. No. 13/968,007, Hendrix et al.
U.S. Appl. No. 13/794,931, Lu et al.
U.S. Appl. No. 13/794,979, Alderson et al.
U.S. Appl. No. 13/686,353, Hendrix et al.
Parkins and Sommerfeldt, "Narrowband and broadband active control in an enclosure using the acoustic enegy density", Acoustical Society of America, 108(1)192-203, 2000.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al. "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-III 928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
Black, John W., "An Application of Side-Tone in Subjective Tests of Microphones and Headsets", Project Report No. NM 001 064. 01.20, Research Report of the U.S. Naval School of Aviation Medicine, Feb. 1, 1954, 12 pages (pp. 1-12 in pdf), Pensacola, FL, US.
Peters, Robert W., "The Effect of High-Pass and Low-Pass Filtering of Side-Tone Upon Speaker Intelligibility", Project Report No. NM

(56) References Cited

OTHER PUBLICATIONS 001 064.01.25, Research Report of the U.S. Naval School of Aviation Medicine, Aug. 16, 1954, 13 pages (pp. 1-13 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
Abdollahzadeh Milani, et al., "On Maximum Achievable Noise Reduction in ANC Systems",2010 IEEE International Conference on Acoustics Speech and Signal Processing, Mar. 14-19, 2010, pp. 349-352, Dallas, TX, US.
Cohen, Israel, "Noise Spectrum Estimation in Adverse Environments: Improved Minima Controlled Recursive Averaging", IEEE Transactions on Speech and Audio Processing, Sep. 2003, pp. 1-11, vol. 11, Issue 5, Piscataway, NJ, US.
Ryan, et al., "Optimum Near-Field Performance of Microphone Arrays Subject to a Far-Field Beampattern Constraint", J. Acoust. Soc. Am. Nov. 2000, pp. 2248-2255, 108 (5), Pt. 1, Ottawa, Ontario, Canada.
Cohen, et al., "Noise Estimation by Minima Controlled Recursive Averaging for Robust Speech Enhancement", IEEE Signal Processing Letters, Jan. 2002, pp. 12-15, vol. 9, No. 1, Piscataway, NJ, US.
Martin, Rainer, "Noise Power Spectral Density Estimation Based on Optimal Smoothing and Minimum Statistics", IEEE Transactions on Speech and Audio Processing, Jul. 2001, pp. 504-512, vol. 9, No. 5, Piscataway, NJ, US.
Martin, Rainer, "Spectral Subtraction Based on Minimum Statistics", Signal Processing VII Theories and Applications, Proceedings of EUSIPCO-94, 7th European Signal Processing Conference, Sep. 13-16, 1994, pp. 1182-1185, vol. III, Edinburgh, Scotland, U.K.
Booij, et al., "Virtual sensors for local, three dimensional, broadband multiple-channel active noise control and the effects on the quiet zones", Proceedings of the International Conference on Noise and Vibration Engineering, ISMA 2010, Sep. 20-22, 2010, pp. 151-166, Leuven.
Kuo, et al., "Residual noise shaping technique for active noise control systems", J. Acoust. Soc. Am. 95 (3), Mar. 1994, pp. 1665-1668.
Lopez-Caudana, Edgar Omar, "Active Noise Cancellation: The Unwanted Signal and The Hybrid Solution", Adaptive Filtering Applications, Dr. Lino Garcia (Ed.), Jul. 2011, pp. 49-84, ISBN: 978-953-307-306-4, InTech.
Senderowicz, et al., "Low-Voltage Double-Sampled Delta-Sigma Converters", IEEE Journal on Solid-State Circuits, Dec. 1997, pp. 1907-1919, vol. 32, No. 12, Piscataway, NJ.
Hurst, et al., "An improved double sampling scheme for switched-capacitor delta-sigma modulators", 1992 IEEE Int. Symp. on Circuits and Systems, May 10-13, 1992, vol. 3, pp. 1179-1182, San Diego, CA.
Jin, et al. "A simultaneous equation method-based online secondary path modeling algorithm for active noise control", Journal of Sound and Vibration, Apr. 25, 2007, pp. 455-474, vol. 303, No. 3-5, London, GB.
Erkelens, et al., "Tracking of Nonstationary Noise Based on Data-Driven Recursive Noise Power Estimation", IEEE Transactions on Audio Speech and Language Processing, Aug. 2008, pp. 1112-1123, vol. 16, No. 6, Piscataway, NJ, US.
Rao, et al., "A Novel Two State Single Channel Speech Enhancement Technique", India Conference (INDICON) 2011 Annual IEEE, IEEE, Dec. 2011, 6 pages (pp. 1-6 in pdf), Piscataway, NJ, US.
Rangachari, et al., "A noise-estimation algorithm for highly non-stationary environments", Speech Communication, Feb. 2006, pp. 220-231, vol. 48, No. 2. Elsevier Science Publishers.
Parkins, et al., "Narrowband and broadband active control in an enclosure using the acoustic energy density", J. Acoust. Soc. Am. Jul. 2000, pp. 192-203, vol. 108, issue 1, US.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Widrow, B., et al., Adaptive Noice Cancelling; Principles and Applications, Proceedings of the IEEE, Dec. 1975, pp. 1692-1716, vol. 63, No. 13, IEEE, New York, NY, US.
Morgan, et al., A Delayless Subband Adaptive Filter Architecture, IEEE Transactions on Signal Processing, IEEE Service Center, Aug. 1995, pp. 1819-1829, vol. 43, No. 8, New York, NY, US.
Benet et al., Using infrared sensors for distance measurement in mobile roots, Robotics and Autonomous Systems, 2002, vol. 40, pp. 255-266.

* cited by examiner

CONTROL OF AUDIO OUTPUT OF HEADPHONE EARBUDS BASED ON THE ENVIRONMENT AROUND THE HEADPHONE EARBUDS

FIELD OF THE DISCLOSURE

The instant disclosure relates to mobile devices. More specifically, this disclosure relates to audio output of mobile devices.

BACKGROUND

Mobile devices are carried by a user throughout most or all of a day. During the day, the user may encounter many different environments, each with a different background noise characteristic and other acoustic effects. Mobile devices employ noise cancelling to take into account the environmental changes and improve the user's experience while using the mobile device. However, conventional noise cancellation in mobile devices is restricted to receiving information about an environment around the mobile device. That is, an error microphone may be located on the mobile device and recordings taken from the error microphone are used to cancel noise and improve the quality of audio on a telephone call. The error microphone has a fixed position on the mobile device that restricts information about the environment the error microphone may receive.

Shortcomings mentioned here are only representative and are included simply to highlight that a need exists for improved audio devices, particularly for consumer-level devices. Embodiments described here address certain shortcomings but not necessarily each and every one described here or known in the art.

SUMMARY

Headphones, and in particular headphone earbuds, have become a device paired with cellular phones, media players, and other electronic devices. Sensors may be added to the earbuds to determine characteristics of an environment around the headphone earbud. In one embodiment, the sensors integrated with the headphone earbud may measure a distance from the headphone earbud to a user's ear drum. This distance may be used to control an audio output of the headphone earbud, such as through an adaptive noise cancellation (ANC) algorithm. In other embodiments, other characteristics of an environment around the headphone earbud may be measured, such as whether the headphone earbud is inserted into an ear canal and/or a shape of the ear canal.

Control of the audio output from a headphone earbud based on environmental characteristics surrounding the headphone earbud may extend battery life of the overall mobile system, and/or make the overall listening experience more pleasurable and intuitive to a user. In one embodiment, control over the audio output may be performed by an audio integrated circuit (IC) integrated within the headphone earbud. In another embodiment, control over the audio output may be performed by a mobile device, including an audio IC, coupled to the headphone earbud to receive measurements of the environment from the headphone earbud.

Characteristics of an environment around the headphone earbud may be measured with optoelectronic sensors such as, for example, Infrared (IR) emitters and collectors. These sensors may be used as proximity sensors and/or ambient light detectors. Measurements from the optoelectronic sensors may be used to control audio output of the headphone earbuds, such as, for example, by turning on or off features and/or changing volume settings. Optoelectronic sensors may also be integrated into the headphone earbud to measure a distance from a user's ear drum to the speaker and/or microphones inside a headphone earbud.

In one embodiment, by integrating a small IR optoelectronic sensor into left and right headphone earbuds, a set of headphones may have internal control over specific features, such as single channel earbud playback and volume control. In one embodiment, the optoelectronic sensor may send a signal to the earbud audio system, when an ear bud is removed or dislodged from the ear canal, that can mute or stop playback to that specific earbud, while the other can continue to play. In another embodiment, if the earbud is dislodged, but not completely removed from the ear canal, the optoelectronic sensor can detect an increase in ambient light in the ear canal and send a signal to the audio system to increase the volume to that specific earbud, without any input from the end user.

Beyond volume control over the system, an integrated optoelectronic sensor may be integrated into the headphone earbud to face down the ear canal and used to measure the distance from an earbud reference point to the ear drum. The reference distance may be fed back to the audio system as a technique to set volume settings and/or used to create a more accurate transfer function from the headphone earbud speaker to the ear drum to enhance the audio output and/or improve performance on applications such as adaptive noise cancellation (ANC).

According to one embodiment, an apparatus may include a headphone earbud having a speaker; an emitter; and/or a collector operating with the emitter and configured to measure at least one characteristic of an environment around the headphone earbud, wherein an output of the collector is configured to be coupled to a controller for adjusting an output of the speaker.

In certain embodiments, the emitter includes an optoelectronic emitter, an infrared (IR) emitter, a sonic emitter, and/or a light emitter; the collector includes a corresponding optoelectronic sensor, infrared (IR) sensor, sonic collector, and/or light collector; the controller is configured to perform at least one of analog reflection, digital echo timing, and/or synchronous digital echo timing on the received output of the collector; the controller may be a digital signal processor (DSP); the at least one characteristic may be a distance between the headphone earbud and an ear drum of a user of the headphone earbud; the at least one characteristic may be whether the headphone earbud is inserted in an ear; the controller is configured to reduce the volume of the headphone earbud when the headphone earbud is not inserted in the ear; and/or the collector may operate synchronously with the emitter.

In some embodiments, the apparatus may also include a controller having an audio input node configured to receive an audio signal, a feedback input node coupled to the collector, a processing block coupled to the audio input node and to the feedback input node and configured to modify the audio signal based, at least in part, on at least one characteristic of the environment around the headphone earbud, and/or an audio output node coupled to the speaker and configured to output the modified audio signal; the processing block may be configured to perform adaptive noise cancellation (ANC) based, at least in part, on the at least one characteristic of the environment; and/or the apparatus may also include a microphone and the at least one characteristic may be a distance between the microphone and an ear drum.

According to another embodiment, a method may include transmitting, from a headphone earbud, a signal; receiving, at the headphone earbud, a reflected signal; and/or controlling an audio output of the headphone earbud based, at least in part, on the reflected signal.

In certain embodiments, the emitter may include an optoelectronic emitter, an infrared (IR) emitter, a sonic emitter, and/or a light emitter; the collector may include a corresponding optoelectronic sensor, infrared (IR) sensor, sonic collector, and/or light collector; the step of determining at least one characteristic may include determining a distance between the headphone earbud and an ear drum of a user of the headphone earbud; the step of determining at least one characteristic may include determining whether the headphone earbud is inserted in an ear; the step of controlling the audio output may include performing adaptive noise cancellation (ANC) based, at least in part, on the determined at least one characteristic of the environment.

In some embodiments, the method may also include determining at least one characteristic of an environment around the headphone earbud based, at least in part, on the reflected signal, wherein the step of controlling the audio output comprises controlling the audio output based, at least in part, on the determined at least one characteristic; and/or reducing a volume of the headphone earbud when the headphone earbud is not inserted in the ear.

According to a further embodiment, an apparatus may include a headphone earbud having a speaker; a microphone; an emitter; a collector operating synchronously with the emitter and configured to measure at least one characteristic of an environment around the headphone earbud; and/or a processor coupled to the collector and to the speaker. The processor may be configured to measure a distance from the microphone to an ear drum of a user of the headphone earbud; and/or adjust an output of the speaker based, at least in part, on the measured distance.

In certain embodiments, the digital signal processor (DSP) may be configured to adjust an output of the speaker based, at least in part, on an adaptive noise cancellation (ANC) algorithm; and/or the emitter may include an optoelectronic emitter, an infrared (IR) emitter, a sonic emitter, and/or a light emitter; the collector may include a corresponding optoelectronic sensor, infrared (IR) sensor, sonic collector, and/or light collector.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 1:
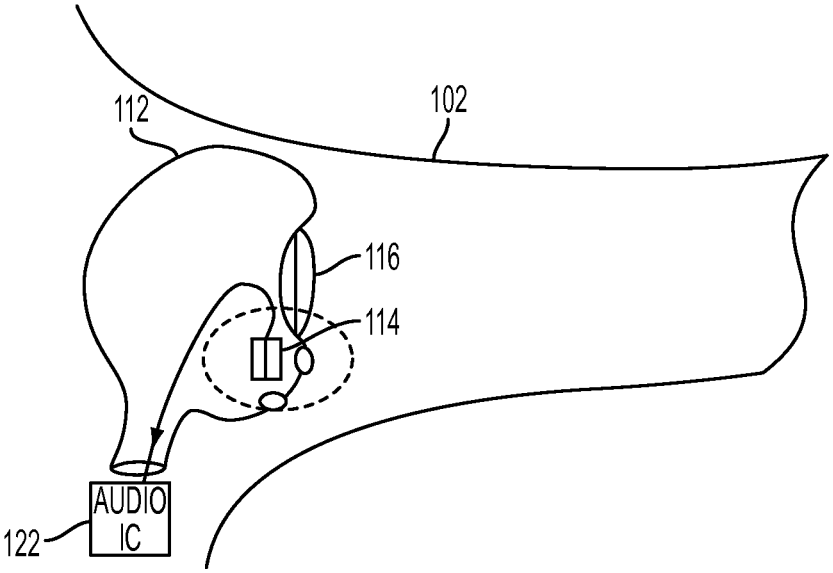
FIG. 1 is a cross-section of an ear canal illustrating a headphone earbud having a measurement device according to one embodiment of the disclosure.

FIG. 1 is a cross-section of an ear canal illustrating a headphone earbud having a measurement device according to one embodiment of the disclosure. A headphone earbud 112 may be inserted into a user's ear canal 102. The headphone earbud 112 may include a speaker transducer 116 for generating sound output in the ear canal 102. The headphone earbud 112 may also include a sensor 114 for measuring a characteristic around the headphone earbud 112 such as, for example, ambient light in the user's ear canal 102. Measurements from the sensor 114 may be relayed to an audio integrated circuit (IC) or ICs 122. The audio IC or ICs 122 may be integrated with the headphone earbud 112 and/or a mobile device or electronic device (not shown) coupled to the headphone earbud 112. Although only one headphone earbud 112 is shown in FIG. 1, additional headphone earbuds may be coupled together to create, for example, stereo sound. Additionally, the headphone earbud 112 may include other components not illustrated in FIG. 1 including, for example, an error microphone for adaptive noise cancellation (ANC).

In one embodiment, the audio IC or ICs 122 may include an audio input node configured to receive an audio signal, such as a music signal from a mobile device. The audio IC or ICs 122 may also include a feedback input node coupled to a collector of the sensor 114. A processing block of the audio IC or ICs 122 may be coupled to the audio input node and to the feedback input node and configured to modify the audio signal based, at least in part, on the at least one characteristic of the environment around the headphone earbud. In one embodiment, the processing block is a digital signal processor (DSP). An audio output node coupled to the speaker transducer 116 and be configured to output the modified audio signal to the speaker transducer 116.

The headphone earbud 112 may also include other components, such as a digital and/or analog microphone for recording sounds in an environment around the headphone earbud 112. Input at the microphone may be input to an adaptive noise cancellation (ANC) algorithm performed by the audio IC or ICs 122. Through adaptive noise cancellation (ANC), the audio IC or ICs 122 may cancel background noise in the environment around the headphone earbud 112. Additionally, a distance between the microphone of the headphone earbud 112 and the user's ear drum may be measured and provided to the audio IC or ICs 122 for input to the adaptive noise cancellation (ANC) algorithm.

Figure 2:
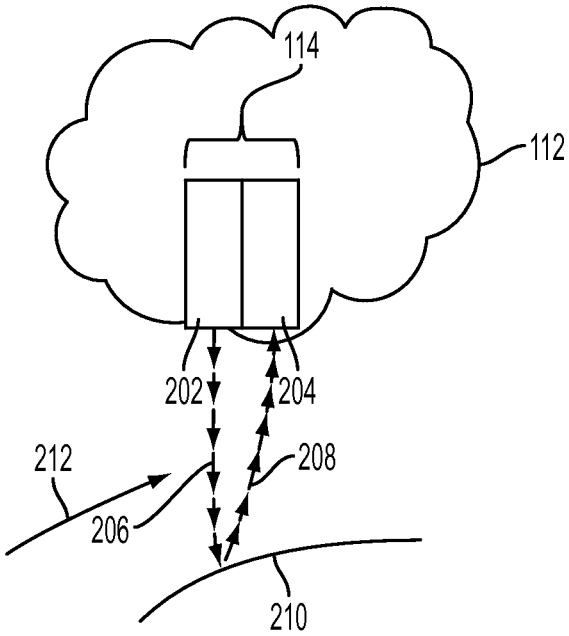
FIG. 2 is a block diagram illustrating an optoelectronic device integrated with a headphone earbud according to one embodiment of the disclosure.

FIG. 2 is a block diagram illustrating an optoelectronic device integrated with a headphone earbud according to one embodiment of the disclosure. The headphone earbud 112 may include a sensor 114 having an emitter 202 and a collector 204. The emitter 202 may be, for example, an optoelectronic emitter, an infrared (IR) emitter, a sonic emitter, and/or a light emitter. The collector 204 may be, for example, an optoelectronic sensor, an infrared (IR) sensor, a sonic collector, and/or a light collector.

The emitter 202 and the collector 204 may operate synchronously, such that output generated by the emitter 202 and/or effects generated by the output of the emitter 202 may be measured by the collector 204. For example, the emitter 202 may generate an output signal 206, such as a light signal, which reflects off a surface 210 as reflected signal 208. The reflected signal 208 may be received by the collector 204 and compared with the output signal 206 to measure a characteristic of an environment around the headphone earbud 112. Additionally, the collector 204 may receive an ambient signal 212 within the environment around the headphone earbud 112, such as ambient light around the headphone earbud 112. In one embodiment, the surface 210 may be a user's ear drum and the measured characteristic by the sensor 114 may be a distance between the headphone earbud 112 and the surface 210.

Figure 3:
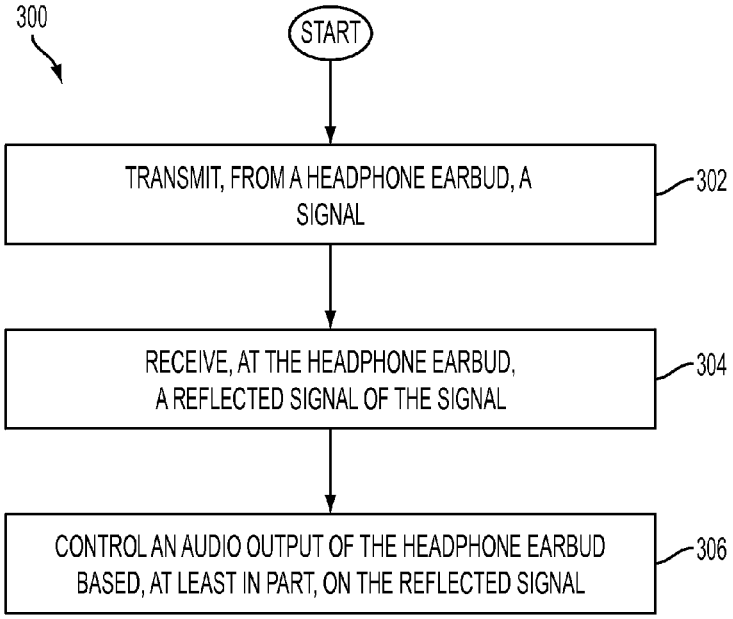
FIG. 3 is a flow chart illustrating control of an audio output of a headphone earbud based on measurements from the headphone earbud according to one embodiment of the disclosure.

After a characteristic of an environment around the headphone earbud is known, the known characteristic may be used to adjust an audio signal output by the headphone earbud. FIG. 3 is a flow chart illustrating control of an audio output of a headphone earbud based on measurements from the headphone earbud according to one embodiment of the disclosure. A method 300 may include, at block 302, transmitting, from a headphone earbud, a signal. Then, at block 304, a reflected signal of the signal may be received at the headphone earbud. The reflected signal received at block 304 may be processed to determine a characteristic of an environment around the headphone earbud. For example, processing may include performing analog reflection, digital echo timing, and/or synchronous digital echo timing. At block 306, an audio output of the headphone earbud may be controlled based, at least in part, on the reflected signal.

Figure 4:
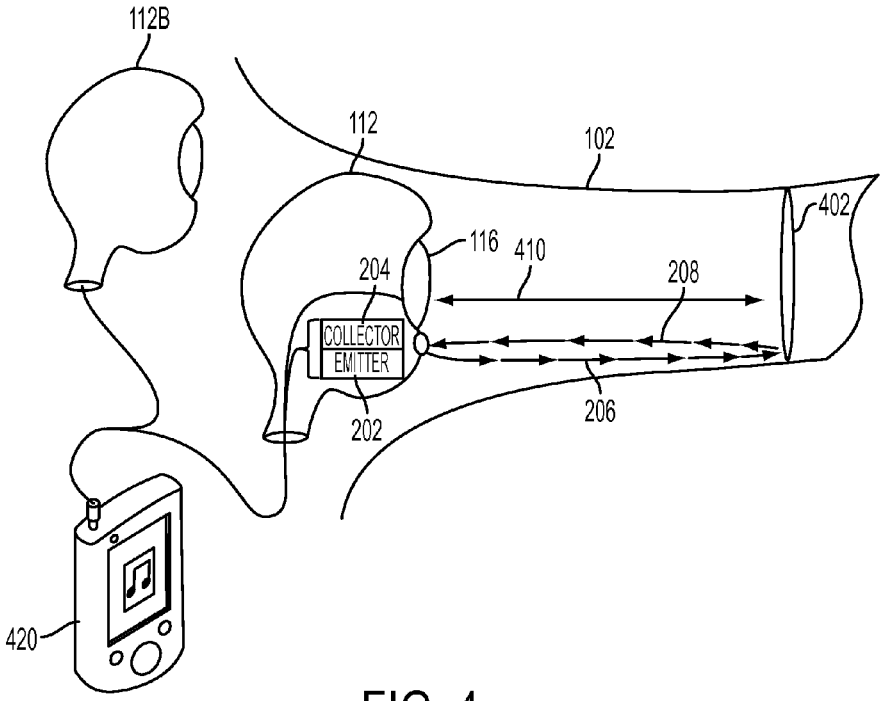
FIG. 4 is a cross-section of an ear canal illustrating a headphone earbud with an integrated optoelectronic device providing feedback to a mobile device for controlling an output of the headphone earbud according to one embodiment of the disclosure.

The headphone earbud may output audio from a coupled mobile device or other electronic device. For example, music may be played through the headphone earbuds and sound levels of the music for a headphone earbud adjusted based on an environment around the headphone earbud. FIG. 4 is a cross-section of an ear canal illustrating a headphone earbud with an integrated optoelectronic device providing feedback to a mobile device for controlling an output of the headphone earbud according to one embodiment of the disclosure. The headphone earbud 112 inserted in the ear canal 102 may measure a distance 410 from the headphone earbud 112 to a user's ear drum 402. The distance 410 may be measured by transmitting signal 206 through the emitter 202 and measuring the reflected signal 208 with the collector 204. For example, a time delay between transmission of the signal 206 and reception of the reflected signal 208 may be used to compute the distance 410 based on a known speed of the signal 206 and the reflected signal 208 through the user's ear canal 102. A second headphone earbud 112B may be similarly configured and inserted in the user's other ear canal (not shown) to provide stereo sound output.

The headphone earbud 112 may return information regarding the distance 410 to a mobile device 420 or other electronic device (not shown). The mobile device 420 may then adjust an output of the music to the headphone earbud 112 to compensate for the distance 410. In one embodiment, the distance 410 may be used to determine whether the headphone earbud 112 is inserted into the user's ear canal 102. For example, if the distance 410 is very large or no reflected signal 208 is detected by the collector 204, then the mobile device 420 may determine the headphone earbud 112 is outside of the ear canal 102.

Figure 5:
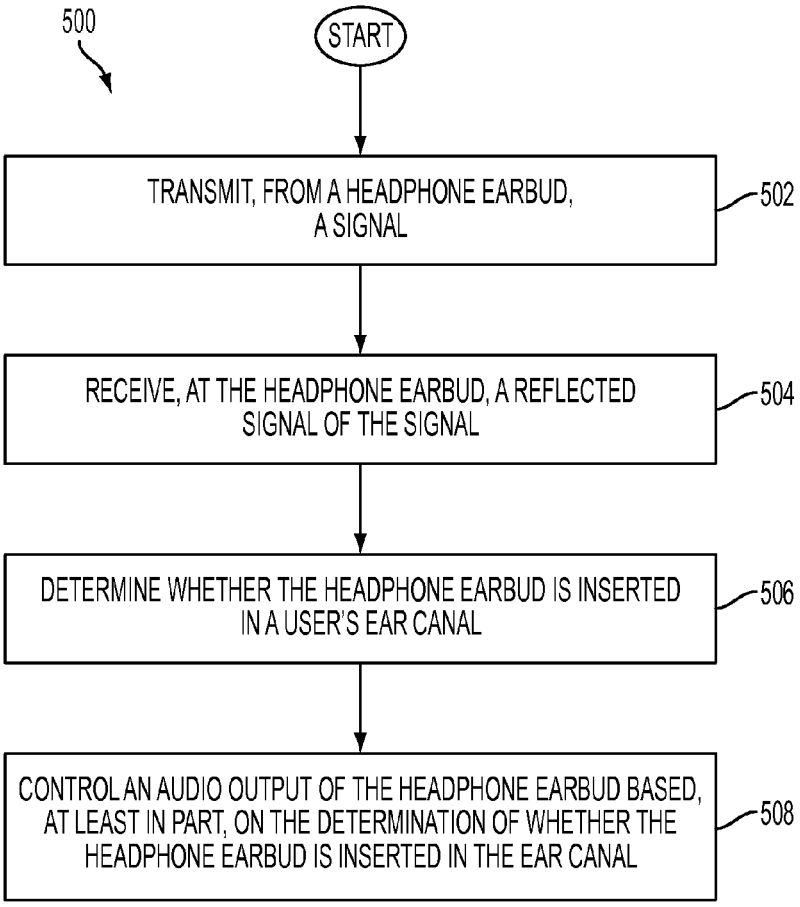
FIG. 5 is a flow chart illustrating control of an output of a headphone earbud based on a determination of an environment around the headphone earbud according to one embodiment of the disclosure.

Audio output through a particular headphone earbud may be shut off if the headphone earbud is removed from the user's ear canal. FIG. 5 is a flow chart illustrating control of an output of a headphone earbud based on a determination of an environment around the headphone earbud according to one embodiment of the disclosure. A method 500 begins at block 502 with transmitting, from a headphone earbud, a signal and continues at block 504 with receiving, at the headphone earbud, a reflected signal of the transmitted signal at block 502. At block 506, it is determined whether the headphone earbud is inserted in a user's ear canal, such as by determining a distance between the headphone earbud and the user's ear canal and/or measuring an ambient light signal. These determinations may include computations based, for example, on analog reflection, digital echo timing, and synchronous digital echo timing on the received reflected signal. In one embodiment when the transmitted signal is an infrared (IR) signal, distance determinations may be calculated as described in "Using infrared sensors for distance measurement in mobile robots" by G. Benet et al published at pp. 255-266 of vol. 40 of the Robotics and Autonomous Systems Journal, which is incorporated by reference herein. In another embodiment, LIDAR (e.g., light radar or light-based detection and ranging) may be used to compute distances. Then, at block 508, an audio output of the headphone earbud is controlled based on the determination at block 506 of whether the headphone earbud is inserted in the ear canal.

For example, when the headphone earbud is removed from the ear canal, audio output to the headphone earbud may be turned off. If one of the two headphone earbuds of a stereo set is inserted, then one of the headphone earbuds may be turned on and the other turned off. In another example, the volume of the headphone earbud may be adjusted as the headphone earbud is removed from or inserted into the ear canal. In one embodiment, the volume is decreased as the headphone earbud is removed from the ear canal. In another embodiment, the volume may be increased as the headphone earbud is removed from the ear canal to allow a user to continue to hear the audio output, but then the audio output is switched off after the headphone earbud is completely removed from the ear canal.

Figure 6:
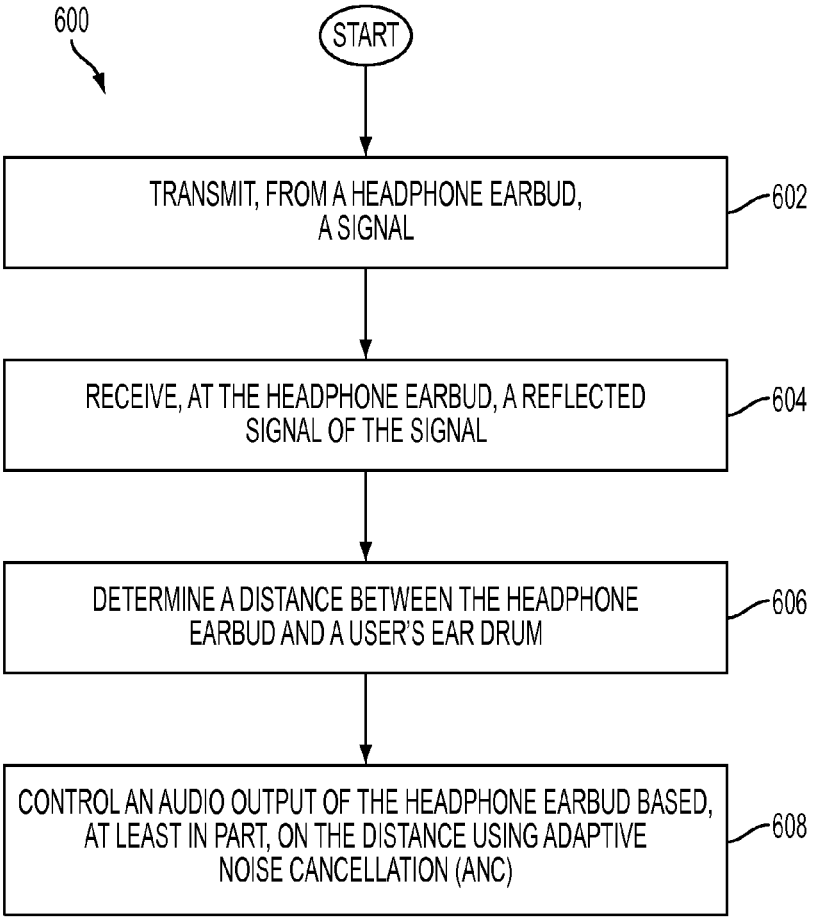
FIG. 6 is a flow chart illustrating control of an output of a headphone earbud with an adaptive noise cancellation (ANC) algorithm using information of an environment around the headphone earbud according to one embodiment of the disclosure.

Audio output through a headphone earbud may be adjusted with adaptive noise cancellation (ANC) using information about the environment around the headphone earbud. FIG. 6 is a flow chart illustrating control of an output of a headphone earbud with an adaptive noise cancellation (ANC) algorithm using information of an environment around the headphone earbud according to one embodiment of the disclosure. A method 600 begins at block 602 with transmitting, from a headphone earbud, a signal and continues at block 604 with receiving, at the headphone earbud, a reflected signal of the signal transmitted at block 602.

Then, at block 606, a distance between the headphone earbud and a user's ear drum may be determined. The distance may be calculated using, for example, analog reflection, digital echo timing, and/or synchronous digital echo timing on the received reflected signal. At block 608, an audio output of the headphone earbud may be controlled based, at least in part, on the distance determined at block 606 through adaptive noise cancellation (ANC).

Figure 7:
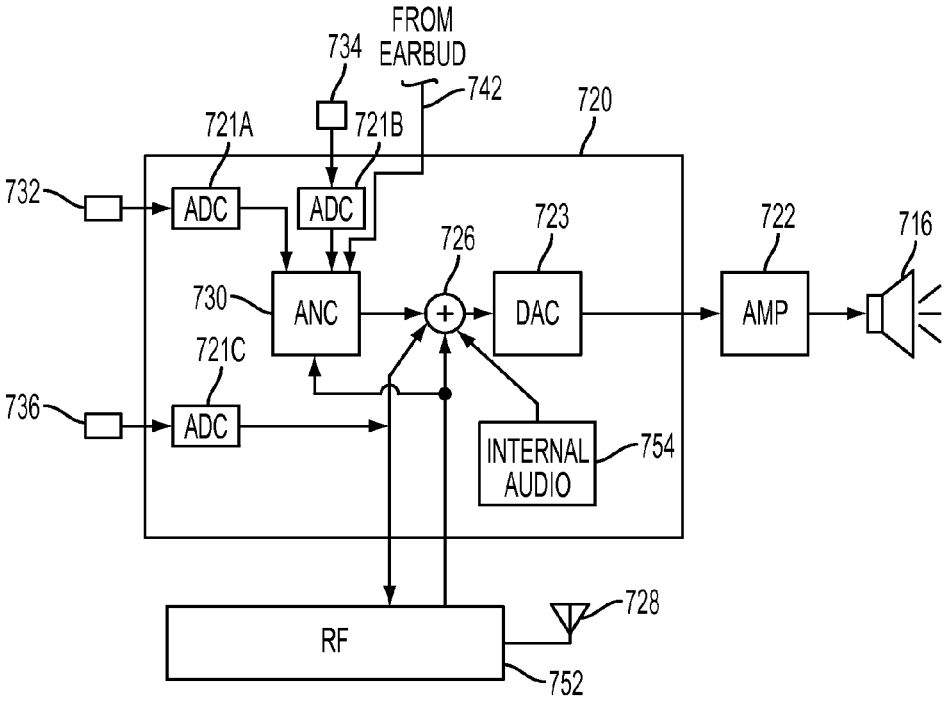
FIG. 7 is a block diagram illustrating a noise canceling system according to one embodiment of the disclosure.

One embodiment of an adaptive noise cancellation (ANC) system for a mobile device, such as the mobile device 420 of FIG. 4, is shown in FIG. 7. FIG. 7 is a block diagram illustrating a noise canceling system according to one embodiment of the disclosure. A circuit 720 may receive input from the microphones 732, 734, and 736. Analog values from the microphones 732, 734, and 736 may be converted by respective analog-to-digital converters (ADCs) 721A, 721B, and 721C. The ADCs 721A, 721B, and 721C may be part of the noise control system or may be built into the microphones 732, 734, and 736, respectively. In one embodiment, the microphones 732, 734, and 736 are digital microphones, and no ADCs are placed between the digital microphones and the circuit 720.

The ANC circuit 730 may generate an anti-noise signal, which is provided to a combiner 726. The anti-noise signal may be adjusted according to information provided by information signal 742 about an environment around a headphone earbud. For example, the information may include measurements from the collector 204 and/or calculated information, such as the distance 410. In some embodiments, measurements from the collector 204 may be used to determine a distance to the user's ear canal or other characteristics of the environment around the headphone earbud for use in generating an anti-noise signal. The distance may be calculated using, for example, analog reflection, digital echo timing, and/or synchronous digital echo timing on the received reflected signal.

The combiner 726 combines the anti-noise signal from the ANC circuit 730 with sound from the near speech microphone 736, internal audio 754, and audio signals received wirelessly through an antenna 728 and processed by a radio frequency (RF) circuit 752. The internal audio 726 may be, for example, ringtones, audio files, and/or audio portions of video files. Audio signals received through the antenna 728 may be, for example, streamed analog or digital audio signals and/or telephone conversations. The combiner 726 provides a single signal to a digital-to-analog converter (DAC) 723. The DAC 723 converts the digital signal of the combiner 723 to an analog audio signal for amplification by the amplifier 722 and output at the speaker 704.

Additional details regarding ANC may be found in U.S. patent application Ser. No. 13/943,454 filed on Jul. 16, 2013, the contents of which are hereby incorporated by reference.

The audio output control, described above and with reference to FIGS. 3, 5, and 6, of the headphone earbud may be implemented within a mobile device or electronic device coupled to the headphone earbud, such as in an audio integrated circuit (IC). The audio output control may also be implemented within the headphone earbud in an audio IC embedded in the headphone earbud. Whether the audio control is located within the headphone earbud, a mobile device, or an electronic device, the audio control may be implemented in firmware and/or software.

If implemented in firmware and/or software, the functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and certain representative advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. An apparatus, comprising:

a headphone earbud, comprising:

a speaker;

an emitter; and a collector operating with the emitter and configured to measure at least one characteristic of an environment around the headphone earbud, wherein the at least one characteristic comprises a numerically-valued distance between the headphone earbud and an ear drum of a user of the headphone earbud, wherein an output of the collector is configured to be coupled to a controller for adjusting an output of the speaker, wherein the numerically-valued distance is calculated based, at least in part, on a time delay between transmission of an initial signal from the emitter and receipt at the collector of a reflected signal comprising the initial signal reflected from the ear drum, and wherein the controller is configured to perform adaptive noise cancellation (ANC) by adjusting a transfer function from the headphone earbud to the ear drum based, at least in part, on the numerically-valued distance.

2. The apparatus of claim 1, wherein the emitter comprises at least one of an optoelectronic emitter, an infrared (IR) emitter, a sonic emitter, and a light emitter and the collector comprises a corresponding at least one of an optoelectronic sensor, an infrared (IR) sensor, a sonic collector, and a light collector.

3. The apparatus of claim 1, wherein the controller is configured to perform at least one of analog reflection, digital echo timing, and synchronous digital echo timing on the received output of the collector.

4. The apparatus of claim 1, wherein the headphone earbud further comprises the controller, and wherein the controller comprises:

an audio input node configured to receive an audio signal;

a feedback input node coupled to the collector;

a processing block coupled to the audio input node and to the feedback input node and configured to modify the audio signal based, at least in part, on the at least one characteristic of the environment around the headphone earbud to generate a modified audio signal; and an audio output node coupled to the speaker and configured to output the modified audio signal.

5. The apparatus of claim 4, wherein the controller comprises a digital signal processor (DSP).

6. The apparatus of claim 4, wherein the processing block is configured to perform adaptive noise cancellation (ANC) based, at least in part, on the at least one characteristic of the environment.

7. The apparatus of claim 1, wherein the headphone earbud further comprises a microphone, and wherein the at least one characteristic further comprises a distance between the microphone and the ear drum.

8. The apparatus of claim 1, wherein the at least one characteristic further comprises whether the headphone earbud is inserted in an ear, wherein the headphone earbud is determined to be not inserted in the ear when the numerically-valued distance is less than a threshold value.

9. The apparatus of claim 8, wherein the controller is configured to reduce the volume of the headphone earbud when the headphone earbud is determined to be not inserted in the ear.

10. The apparatus of claim 1, wherein the collector operates synchronously with the emitter.

11. The apparatus of claim 1, wherein the controller is further configured to:

detect, based on an output of the collector, that the headphone earbud is at least partially dislodged from the ear and, in response, increase a volume to the headphone earbud; and detect, based on the output of the collector, that the headphone earbud is removed from the ear and, in response, mute the headphone earbud.

12. A method, comprising:

transmitting, from a headphone earbud, a signal;

receiving, at the headphone earbud, a reflected signal;

determining at least one characteristic of an environment around the headphone earbud based, at least in part, on the reflected signal, wherein the step of determining the at least one characteristic comprises determining a numerically-valued distance between the headphone earbud and an ear drum of a user of the headphone earbud; and controlling an audio output of the headphone earbud based, at least in part, on the determined at least one characteristic, wherein the numerically-valued distance is determined based, at least in part, on a time delay between transmission of the signal and receipt of the reflected signal reflected from the ear drum corresponding to the signal, and wherein the step of controlling the audio output comprises performing adaptive noise cancellation (ANC) by adjusting a transfer function from the headphone earbud to the ear drum based, at least in part, on the numerically-valued distance.

13. The method of claim 12, wherein the step of transmitting the signal comprises transmitting at least one of an optoelectronic signal, an infrared (IR) signal, a sonic signal, and a light signal.

14. The method of claim 12, wherein the step of determining at least one characteristic comprises determining whether the headphone earbud is inserted in an ear, wherein the headphone earbud is determined to be not inserted in the ear when the numerically-valued distance is less than a threshold value.

15. The method of claim 14, further comprising reducing a volume of the headphone earbud when the headphone earbud is determined to be not inserted in the ear.

16. The method of claim 12, further comprising:

detecting, based on the at least one characteristic of an environment, that the headphone earbud is at least partially dislodged from the ear and, in response, increasing a volume to the headphone earbud; and detecting, based on the at least one characteristic of an environment, that the headphone earbud is removed from the ear and, in response, muting the headphone earbud.

17. An apparatus, comprising:

a headphone earbud, comprising:

a speaker;

a microphone;

an emitter;

a collector operating synchronously with the emitter and configured to measure at least one characteristic of an environment around the headphone earbud;

a processor coupled to the collector and to the speaker and configured to:

measure a numerically-valued distance from the microphone to an ear drum of a user of the headphone earbud based on a signal received from the collector;

measure the numerically-valued distance based, at least in part, on a time delay between transmission of an initial signal from the emitter and a reflected signal reflected from the ear drum of the initial signal; and perform adaptive noise cancellation (ANC) to adjust the output of the speaker by adjusting a transfer function from the headphone earbud to the ear drum based, at least in part, on the numerically-valued distance.

18. The apparatus of claim 17, wherein the emitter comprises at least one of an optoelectronic, an infrared (IR) emitter, a sonic emitter, and a light emitter and the collector comprises a corresponding at least one of an optoelectronic sensor, an infrared (IR) sensor, a sonic collector, and a light collector.

19. The apparatus of claim 17, wherein the emitter comprises an infrared (IR) emitter and the collector comprises an infrared (IR) collector.

20. The apparatus of claim 17, wherein the processor is further configured to:

detect, based on an output of the collector, that the headphone earbud is at least partially dislodged from the ear and, in response, increase a volume to the headphone earbud; and detect, based on the output of the collector, that the headphone earbud is removed from the ear and, in response, mute the headphone earbud.

* * * * *